United States Patent [19]

Cypher

[11] 4,000,593

[45] Jan. 4, 1977

[54] INSULATING SPANDREL GLAZING UNIT

[75] Inventor: James H. Cypher, New Kensington, Pa.

[73] Assignee: PPG Industries, Inc., Pittsburgh, Pa.

[22] Filed: Oct. 10, 1972

[21] Appl. No.: 296,478

Related U.S. Application Data

[63] Continuation of Ser. No. 65,813, Aug. 21, 1970, abandoned.

[52] U.S. Cl. ..... 52/172; 52/308; 52/616

[51] Int. Cl.[2] ..... E06B 7/12; E04B 2/28

[58] Field of Search ..... 52/172, 306–308, 52/31, 616, 38, 398

[56] References Cited

UNITED STATES PATENTS

| | | | |
|---|---|---|---|
| 2,193,207 | 3/1940 | Rosen | 52/38 X |
| 2,269,018 | 1/1942 | Guignan | 52/308 |
| 2,684,266 | 7/1954 | Englehardt et al. | 52/172 |
| 2,838,809 | 6/1958 | Zeolla et al. | 52/172 |
| 2,838,810 | 6/1958 | Englehardt et al. | 52/172 |
| 3,167,823 | 2/1965 | Palfey | 52/398 X |
| 3,319,388 | 5/1967 | Olsen | 52/235 |
| 3,457,138 | 7/1968 | Miller | 52/616 |

FOREIGN PATENTS OR APPLICATIONS

| | | | |
|---|---|---|---|
| 662,476 | 5/1963 | Canada | 52/308 |
| 988,609 | 4/1954 | France | 52/398 |
| 1,452,908 | 8/1966 | France | 52/616 |

*Primary Examiner*—Price C. Faw, Jr.
*Assistant Examiner*—Leslie Braun
*Attorney, Agent, or Firm*—Dennis G. Millman

[57] ABSTRACT

Disclosed is an insulating, hermetically sealed, glazing unit comprised of a transparent, strengthened glass panel and a metal panel disposed in opposed, spaced relation to each other, marginal edge spacing means defining with said panel a continuous, hermetically sealed space therebetween and desiccant material in communication with said space between said panels.

11 Claims, 2 Drawing Figures

INSULATING SPANDREL GLAZING UNIT

Figure 1:
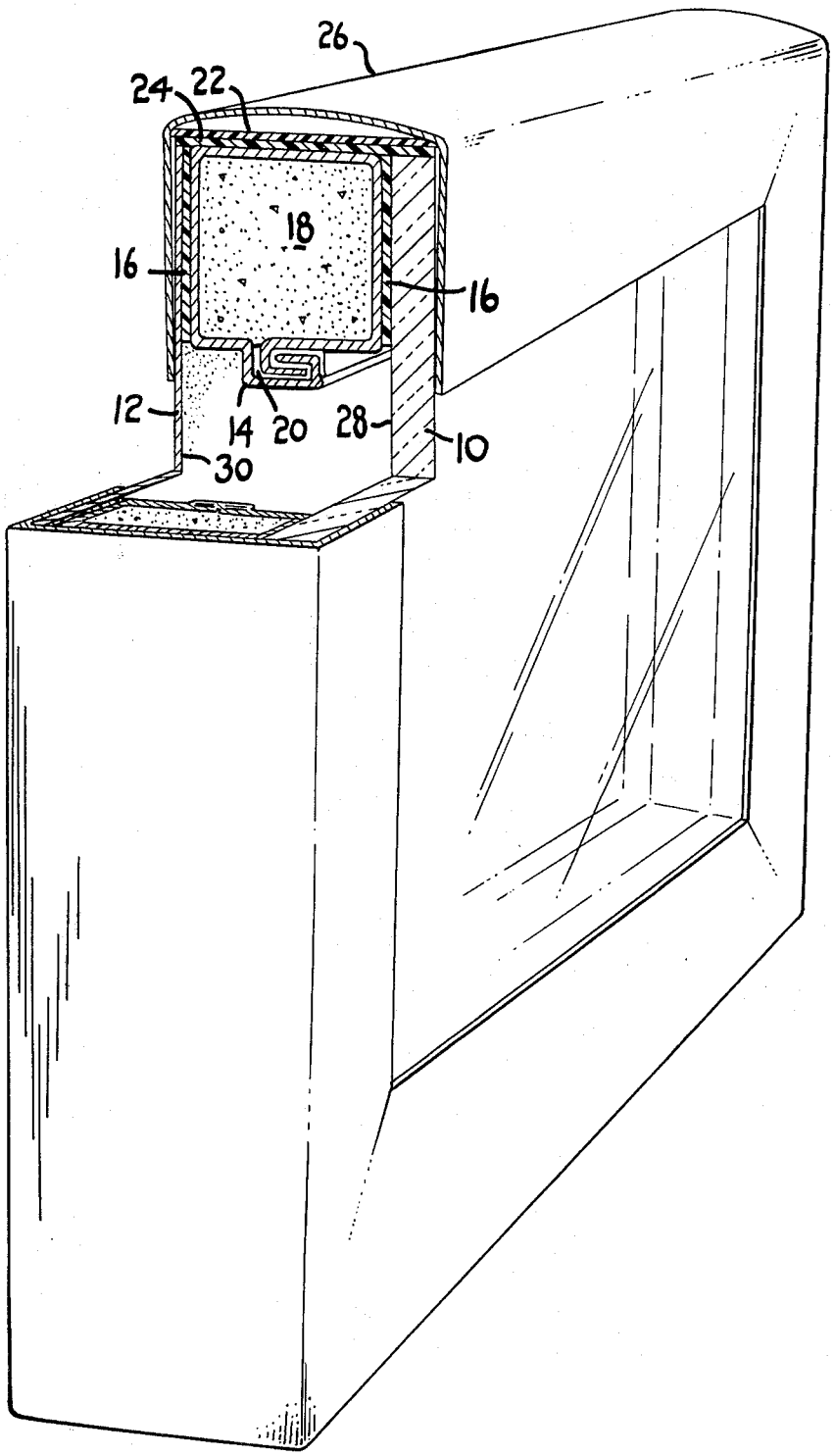

This is a continuation of application Ser. No. 65,813, filed Aug. 21, 1970, now abandoned.

BACKGROUND OF THE INVENTION

The present invention relates to architectural glazing units and, in particular, to opaque, insulating, hermetically sealed, glazing units.

More specifically, this invention provides, as a new article of manufacture, a novel type of glazing unit particularly suitable for glazing the spandrel areas of the exterior walls of multi-story buildings.

A spandrel area, as the term is used herein, refers to the opaque area, as contrasted to the vision area of a curtain wall, which is formed by the use of spandrel panels which are either intrinsically opaque or are rendered opaque by various backing or coating materials. Spandrel panels are designed to be employed to thermally isolate and conceal certain portions of the exterior structure of a building, as well as conceal interiorly located building fixtures. Thus, spandrel panels or spandrels are frequently employed to conceal floor slabs, the vertical span between floors and ceilings or between successive viewing closures, heating and air conditioning convectors and the like. Spandrel panels are principally employed to conceal those portions of a building that would not be aesthetically pleasing if capable of being viewed from the exterior of a building. However, spandrel panels also find use in building zones where it is desired to maintain a degree of privacy, such as at the ground level of a building.

In the past, various attempts have been directed toward producing spandrel panels that closely match or pleasingly contrast in color and reflectivity with adjacent, transparent glass panels in the viewing or vision areas of a building. The best of such attempts to date involve either using tempered, multiple glazed spandrel panels or tempered, single glazed spandrel panels provided with multiple coatings to obtain the desired color and reflectivity. In either case, such panels are quite expensive for use solely to conceal aesthetically unpleasing portions of a building.

In accordance with the present invention, there is provided a functionally desirable spandrel glazing unit that is relatively inexpensive to construct and that can be readily adapted to closely match, in color and reflectivity, the color and reflectivity normally exhibited in daylight by adjacent vision panels. This is preferably accomplished by providing an insulating, hermetically sealed glazing unit comprising a transparent, strengthened glass panel and a metal panel disposed in opposed, spaced relation to each other, marginal edge spacer means defining with said panels a continuous, hermetically sealed space therebetween and desiccant material in communication with the space between the panels. The glass panel of the unit can be clear, tinted (colored), coated or coated and tinted and the metal panel can be either coated or uncoated so that, in combination, there is provided the desired color and reflectivity.

Figure 2:
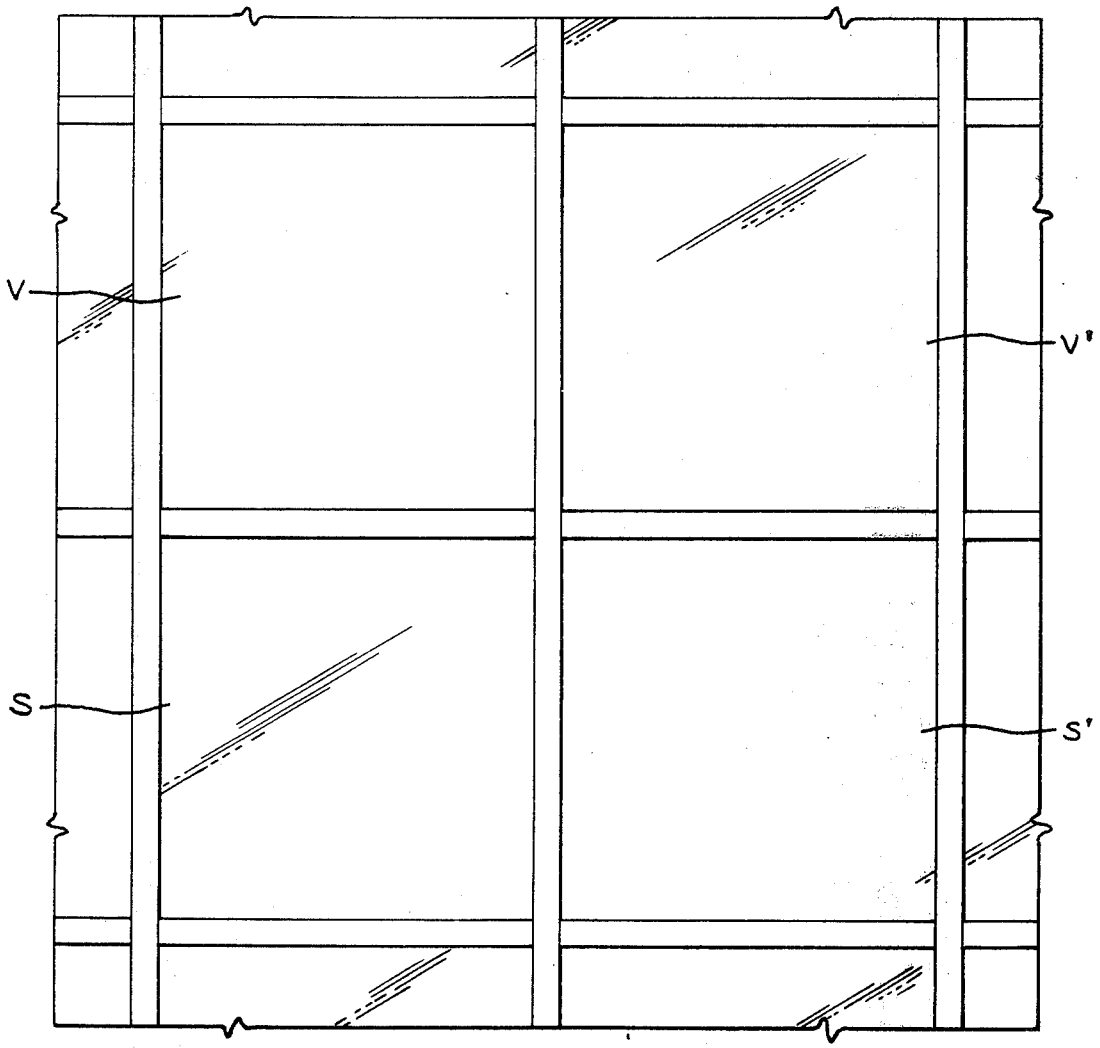

The foregoing and other objects, features and advantages of the present invention will become more apparent from that which follows, when taken in conjunction with the drawings, wherein:

FIG. 1 is a perspective view, partly in section, of an opaque, insulating, hermetically sealed, glazing unit embodying the principles of this invention; and FIG. 2 is a front elevation of a building curtain wall structure including opaque spandrel glazing units (S, S') as shown in FIG. 1 in combination with transparent vision area glazing units (V, V').

Spandrel glazing units within the contemplation of this invention generally comprise a transparent, strengthened glass panel 10 and a metal panel 12 spaced from one another to provide a continuous, insulating space between the panels. This space is effective for substantially reducing the passage of heat through the unit due to convection and conduction. In one typical type of multiple glazed unit, the glass panel 10 and metal panel 12 are spaced from each other by a marginal edge spacer element 14 extending around the periphery of the glass and metal panels. In this type of unit, the glass panel 10 and metal panel 12 are generally adhered to the spacer element 14 by a moisture-resistant, air-impermeable, mastic composition 16 forming a continuous film around the edges of the panels, between each panel and the spacer element 14, to provide a primary hermetic seal.

The spacer element 14 of the above-mentioned unit may be tubular in shape and filled with a desiccant 18, such as silica gel. The particular spacer element shown is fully disclosed in U.S. Pat. No. 2,684,266, assigned to the assignee of the present invention and the disclosure of which is incorporated herein by reference. Openings 20, in the spacer element shown, communicate with the insulating space of the unit and the inside tubular portion of the spacer so that moisture within the space of the unit will be adsorbed by the desiccant 18. Alternatively, in lieu of spacer 14 and desiccant 18, a composite spacer-dehydrator element can be used, such as is now disclosed in applicant's assignee's U.S. application Ser. No. 42,712, now abandoned the disclosure of which is also intended to be incorporated herein by reference. Broadly, the spacer-dehydrator of the above-mentioned application comprises a desiccant material dispersed in a matrix of moisture vapor transmittable material, such as a thermoplastic, block copolymer of styrene-butadiene rubber.

In the embodiment shown, a flexible and, preferably, resilient, moisture-resistant strip 22 with a layer of moisture-resistant and/or air-impermeable mastic 24 adhered thereto is preferably placed around the peripheral edges of the panels 10 and 12 and the spacer element 14 to provide a secondary hermetic seal. Also, as shown, a channel 26 of substantially U-shaped cross section is preferably affixed around the periphery of the unit to protect the peripheral edges of the glass panel 10 and hold the marginal edges of the unit together under slight tension.

In accordance with this invention, tempered or strengthened glass panel 10 is transparent and may be clear, tinted (colored), coated or coated and tinted. Typical tinted glasses that may be used for this panel include conventional soda-lime-silica glass containing about one-half percent iron oxide to tint the glass green, a bronze glass disclosed in U.S. Pat. No. 3,296,004, and a gray or neutral colored glass disclosed in U.S. Pat. Reissue No. 25,312. Typical transparent coatings that may be applied to the inner surface 28 of this panel include those disclosed in U.S. Pat. Nos. 3,185,586, 3,411,934 and 3,457,138 and U.S. applications Ser. Nos. 16,670, now U.S. Pat. No. 3,660,061, 869,644, now U.S. Pat. No. 3,652,246, 829,705, now U.S. Pat. No. 3,671,291, 829,755, now U.S. Pat. No. 3,672,939, 57,451, now U.S. Pat. No. 3,723,158, 57,527, now U.S. Pat. No. 3,723,155, 57,575, now abandoned and 57,754, now U.S. Pat. No. 3,674,517 all assigned to the assignee of this invention and the disclosures of which are specifically incorporated herein by reference.

Metal panel 12, on the other hand, may be coated or uncoated. If coated, a wide variety of opaque and/or pigmented or tinted coating materials may be used to coat the inner surface 30 of metal panel 12. Also, panel 12 may be composed of galvanized steel or anodized aluminum, either coated or uncoated on inner surface 30.

For the purposes of this invention, of course, when glass panel 10 and/or metal panel 12 are coated, a substantially uniform, continuous coating is applied to the entire visible inner surface thereof. Moreover, it has been found that metal panel 12 should desirably have a thickness up to one-third the thickness of glass panel 10. Thicker panels add little to the structural integrity of the unit and, accordingly, merely add to the materials cost of the unit.

By judicious selection of glass panels, metal panels and coating materials, a wide variety of aesthetically pleasing spandrel glazing units can be produced to closely match and/or complement, in color and reflectivity, the color and reflectivity normally exhibited in daylight by adjacent vision panels in a curtain wall structure as shown in FIG. 2. For example, a multiple glazed vision panel or unit comprised of a pair of clear, soda-lime-silica glass panels with the outside panel coated on its inner surface with a transparent copper film, in accordance with U.S. Pat. No. 3,457,138, is closely matched in color and reflectivity by a spandrel glazing unit, constructed in accordance with this invention, and comprised of an outside, clear, soda-lime-silica glass panel 10 coated on its inner surface 28, according to the above-mentioned patent, with a transparent copper film and having a Paint-lok galvanized steel panel 12 coated on its inner surface 30 with a light gray coating of galvanized steel primer 6-206, white with tint M-494, manufactured by PPG Industries, Inc.

As a further example, a multiple glazed vision panel or unit comprised of a clear, soda-lime-silica outside glass panel coated on its inner surface with a transparent metal oxide film comprised of a mixture of iron oxide, chromium oxide and cobalt oxide, in accordance with U.S. application Ser. No. 16,670, now U.S. Pat. No. 3,660,061 and having a clear, soda-lime-silica glass inside panel coated on its inner surface with a transparent nickel film, pursuant to the disclosure of U.S. application Ser. No. 57,575, now abandoned has been found to closely match, in color and reflectivity, a spandrel glazing unit constructed in accordance with this invention and comprised of a clear, soda-lime-silica outside glass panel 10 coated on its inner surface 28 with the above-mentioned transparent metal oxide film and a metal panel 12 coated on its inner surface 30 with a dark gray enamel coating tinted with yellow.

Although the present invention has been described with particular reference to the specific details of certain embodiments thereof, it is not intended that such details shall be regarded as limitations upon the scope of the invention except insofar as included in the accompanying claims.

I claim:

1. An insulating spandrel glazing unit comprising no more than one transparent, strengthened, glass panel and no more than one metal disposed in opposed, spaced relation to each other, said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, hermetically sealed space therebetween, wherein said glass panel has a transparent coating on its inner surface and said metal panel has a coating on its inner surface.

2. The glazing unit of claim 1 wherein said transparent coating is reflective.

3. The glazing unit of claim 1 wherein said metal panel is a galvanized steel panel.

4. An insulating spandrel glazing unit comprising no more than one transparent, strengthened, glass panel and no more than one metal panel disposed in opposed, spaced relation to each other, said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, hermetically sealed space therebetween, wherein said glass panel is tinted and said metal panel has a coating on its inner surface.

5. An insulating spandrel glazing unit comprising no more than one transparent, strengthened, glass panel and no more than one metal panel disposed in opposed, spaced relation to each other, said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, hermetically sealed spaced therebetween wherein said glass panel is tinted and has a transparent coating on its inner surface and said metal panel has a coating on its inner surface.

6. The glazing unit of claim 5 wherein said transparent coating is reflective.

7. An insulating spandrel glazing unit comprising no more than one transparent, strengthened, glass panel and no more than one metal panel disposed in opposed, spaced relation to each other, said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, hermetically sealed space therebetween, wherein said glass panel has a transparent coating on its inner surface and said metal panel is uncoated on its inner surface.

8. The glazing unit of claim 7 wherein said transparent coating is reflective.

9. An insulating spandrel glazing unit comprising no more than one transparent, strengthened, glass panel and no more than one metal panel disposed in opposed, spaced relation to each other, said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, heremetically sealed space therebetween, wherein said glass panel is tinted and said metal panel is uncoated on its inner surface.

10. An insulating spandrel glazing unit comprising no more than one transparent, strengthened, glass panel and no more than one metal panel disposed in opposed, spaced relation to each other, said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, hermetically sealed spaced therebetween, wherein said glass panel is tinted and has a transparent coating on its inner surface and said metal panel is uncoated on its inner surface.

11. The glazing unit of claim 10 wherein said transparent coating is reflective.

* * * * *

UNITED STATES PATENT AND TRADEMARK OFFICE

CERTIFICATE OF CORRECTION

PATENT NO. : 4,000,593

DATED : January 4, 1977

INVENTOR(S) : James H. Cypher

It is certified that error appears in the above-identified patent and that said Letters Patent are hereby corrected as shown below:

Column 3, line 68, Claim 1, after "metal" please insert --panel--.

Column 4, line 39, Claim 5, "spaced" should be --space--.

Column 6, line 5, Claim 10, "spaced" should be --space--.

Column 6, line 11, please add the following claim:

--12. In combination as part of a building wall structure, an insulating, hermetically sealed, multiple glazed vision unit comprised of a pair of transparent glass sheets disposed in opposed, spaced relation to each other and having a spacer element disposed about their opposed marginal edges to define with said sheets a closed space therebetween; and an adjacent insulating spandrel glazing unit comprising no more than one transparent, strengthened, glass panel and no more than one metal panel disposed in opposed, spaced relation to each other, and said metal panel having a thickness substantially less than the thickness of said glass panel and being visible through said glass panel, the entire inner visible surface of said metal panel being provided with a uniform, continuous finish so as to present a uniform, continuous appearance through said glass panel, and marginal edge spacer means defining with said panels a closed, hermetically sealed space therebetween, said spandrel unit closely matching said vision unit in color and reflectivity in normal daylight.--

On the cover sheet, "11 Claims, 2 Drawing Figures" should read -- 12 Claims, 2 Drawing Figures --.

Signed and Sealed this

Twelfth Day of April 1977

[SEAL]

*Attest:*

RUTH C. MASON
*Attesting Officer*

C. MARSHALL DANN
*Commissioner of Patents and Trademarks*